US007985049B1

(12) United States Patent
Liang

(10) Patent No.: US 7,985,049 B1
(45) Date of Patent: Jul. 26, 2011

(54) TURBINE BLADE WITH IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1039 days.

(21) Appl. No.: 11/880,411

(22) Filed: Jul. 20, 2007

(51) Int. Cl.
*F01D 5/18* (2006.01)

(52) U.S. Cl. ..... 416/97 R

(58) Field of Classification Search ..... 416/97 R; 415/115

See application file for complete search history.

(56) References Cited

U.S. PATENT DOCUMENTS

| | | | | |
|---|---|---|---|---|
| 5,947,687 | A | 9/1999 | Mori et al. | |
| 6,274,215 | B1 * | 8/2001 | Brainch et al. | 428/77 |
| 6,390,775 | B1 | 5/2002 | Paz | |
| 6,419,447 | B1 | 7/2002 | Watanabe et al. | |
| 6,761,536 | B1 | 7/2004 | Bash et al. | |
| 6,984,112 | B2 | 1/2006 | Zhang et al. | |
| 7,121,803 | B2 | 10/2006 | Gautreau et al. | |
| 7,165,944 | B2 | 1/2007 | Gautreau et al. | |
| 2007/0116570 | A1 * | 5/2007 | Boury et al. | 416/97 R |
| 2007/0122282 | A1 * | 5/2007 | Deschamps et al. | 416/97 R |

* cited by examiner

*Primary Examiner* — Justine Yu
*Assistant Examiner* — Aaron R Eastman
(74) *Attorney, Agent, or Firm* — John Ryznic

(57) ABSTRACT

A turbine blade for use in a gas turbine engine that requires internal cooling for the blade. The blade includes a leading edge cooling supply cavity and a trailing edge cooling supply cavity to supply pressurized cooling air from an external source to the internal cooling circuit of the blade. The leading edge cooling supply cavity is connected to a leading edge impingement cavity through metering and impingement holes to provide metering and impingement cooling air to the leading edge region of the blade and to the showerhead film cooling holes. Both the leading edge and the trailing edge cooling supply cavities also supply cooling air through metering and impingement holes to respective pressure side and suction side impingement cavities located between the two supply cavities for impingement cooling. Each impingement cavity is connected to the blade external surface through a row of film cooling holes to discharge the spent impingement cooling air.

11 Claims, 1 Drawing Sheet

TURBINE BLADE WITH IMPINGEMENT COOLING

BACKGROUND OF THE INVENTION

1. Field of the Invention

The present invention relates generally to fluid reaction surfaces, and more specifically to a turbine blade with an internal cooling circuit.

2. Description of the Related Art Including Information Disclosed Under 37 CFR 1.97 and 1.98

A gas turbine engine such as an industrial gas turbine (IGT) includes a turbine section with multiple stages of turbine blades that react with the hot gas flow passing through the turbine to convert the combustion gas flow into mechanical work to drive the compressor and the output shaft. The efficiency of the engine can be increased by passing a higher temperature gas flow through the turbine. However, the temperature limit of the hot gas flow entering the turbine is limited to the metal properties of the turbine blades, especially in the first stage. For this reason, the turbine blades are provided with complex internal cooling circuits to provide cooling of the blade so that the hot gas flow temperature can exceed the thermal properties of the blade.

Since the compressed air used to cool the blades is also bled off from the engine (from the compressor), the engine efficiency can also be increased by using a minimal amount of bleed off air to perform the maximum amount of blade cooling. The turbine blades can also be affected by erosion occurring from the hot gas flow in areas where hot spots can occur on the blade. Some areas on the blade may be over-cooled while other areas are under-cooled, leading to hot spots. Inadequate cooling of the rotor blades can also affect the amount of creep that can occur. In an IGT, the engine can operate non-stop for 24,000 to 48,000 hours before a shutdown will occur. Because the rotor blades are operating under very high temperatures and are exposed to high stress levels from the rotation of the engine, the metallic material can become plastic and distort in the direction of the high centrifugal forces. Thus, it is highly desirable to provide for adequate cooling of all portions of the rotor blades in order to maximize the efficiency of the engine and prolong the life of the rotor blades.

It is therefore an object of the present invention to provide for a turbine blade with a cooling circuit that utilizes multiple metering and impingement cooling in order to increase the engine efficiency and improve the turbine blade life.

BRIEF SUMMARY OF THE INVENTION

The turbine blade includes a leading edge and a trailing edge, and a pressure side and a suction side to form the airfoil portion of the blade. A leading edge cooling supply cavity supplies cooling air to the blade for the leading edge cooling and for the pressure side and suction side walls adjacent to the cavity. Impingement cooling holes connect the cavity to a leading edge impingement cavity located along the leading edge of the blade that supplies a showerhead arrangement for cooling the leading edge. A pressure side impingement cavity and a suction side impingement cavity are also connected to the supply cavity through impingement holes to provide impingement cooling for the pressure side and suction side walls of these cavities. A row of film cooling holes on both of the impingement cavities discharge film cooling air onto the pressure side and suction side walls to provide film cooling of the blade external surfaces.

A trailing edge cooling supply cavity supplies cooling air to the trailing edge region of the blade and is connected to a pressure side and a suction side impingement cavity through impingement holes. Cooling air from the trailing edge cooling supply cavity flows into the impingement cavities on the pressure and suction sides to provide impingement cooling to the pressure and suction side walls. A row of film cooling holes on both of the impingement cavities discharge film cooling air onto the pressure and suction side wall surfaces of the blade. the trailing edge cooling supply cavity is also connected to a triple impingement cooling hole arrangement in the trailing edge region to provide cooling. a row of trailing edge cooling slots connects the last of the triple impingement cooling cavities to discharge cooling air out from the trailing edge of the blade. A row of film cooling holes on the pressure side of the blade also connects the first and second cavities of the triple impingement cooling cavities to discharge film cooling air onto the pressure side surface of the blade. With the cooling circuit of the present invention, the individual cooling passages can be customized by varying the metering and impingement holes to control the amount of cooling air flow for each section of the blade.

DETAILED DESCRIPTION OF THE INVENTION

Figure 1:
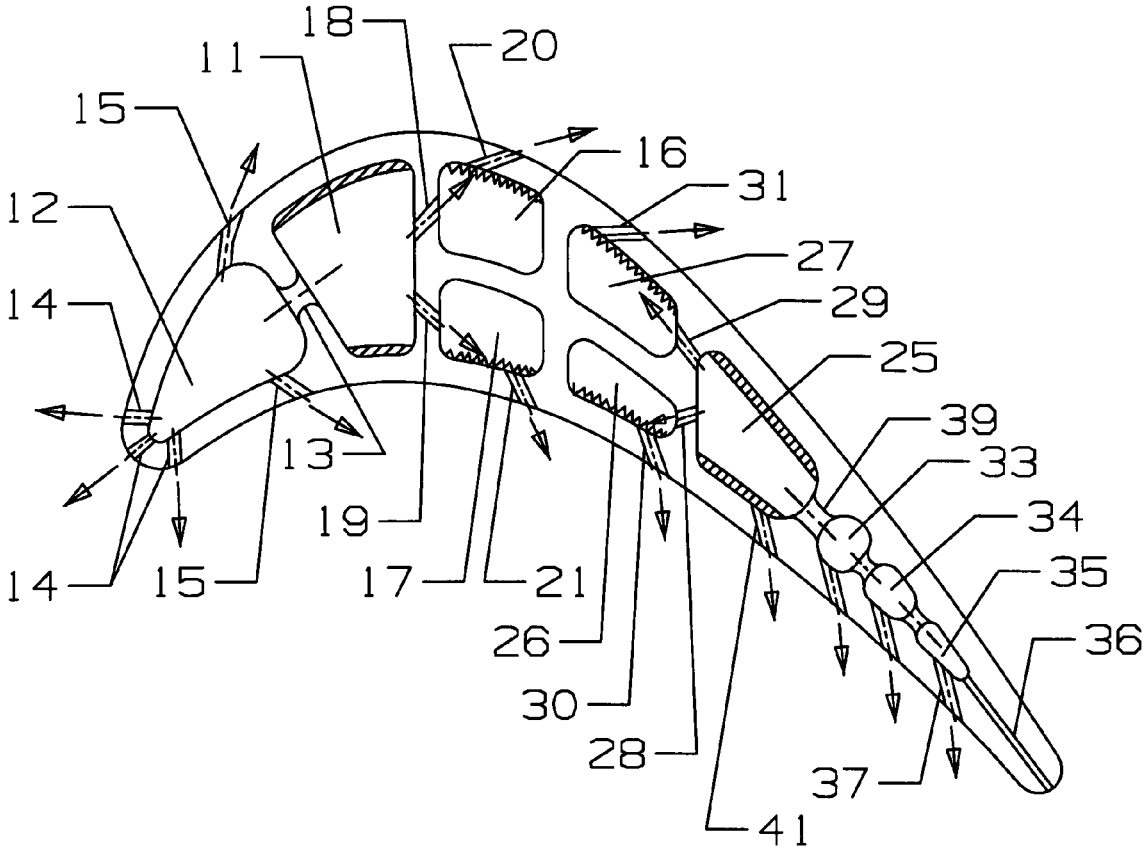
FIG. 1 shows a cut-away view of the cooling circuit of the present invention.

The present invention is a turbine blade used in an industrial gas turbine engine. FIG. 1 shows a cut-away view of the turbine blade with the internal cooling circuit of the present invention. pressurized cooling air is supplied from an external source of the blade to a leading edge cooling supply cavity 11 located in the forward half of the blade. A leading edge impingement cavity 12 is located along the leading edge of the blade and is connected to the cooling supply cavity 11 through one or more leading edge metering and impingement holes 13. The leading edge impingement cavity can be one long cavity extending along the leading edge in the spanwise direction of the blade, or can be a plurality of segmented cavities each being connected to the supply cavity 11 through one or more metering and impingement holes 13. A showerhead arrangement of film cooling holes 14 is located on the leading edge and connected to the leading edge impingement cavity 12. Gill holes 15 located on the pressure and suction sides of the blade downstream from the showerhead holes 14 are also connected to the leading edge impingement cavity 12.

Located on the aft side of the leading edge cooling supply cavity 11 is a pressure side impingement cavity 17 and a suction side impingement cavity 16. The impingement cavities 16 and 17 can each be one cavity extending along the spanwise length of the blade, or each can be segmented into a plurality of cavities extending along the spanwise direction of the blade. Each segment is connected to the supply cavity 11 through one or more impingement holes. One or more metering and impingement holes 18 connect the leading edge supply cavity 11 to the suction side impingement cavity 16. One or more metering and impingement holes 19 connect the leading edge supply cavity 11 to the pressure side impingement cavity 17. A row of film cooling holes 20 discharge film cooling air from the suction side impingement cavity 16 and onto the external surface of the suction side wall. A row of film cooling holes 21 discharge film cooling air from the pressure side impingement cavity 17 and onto the external surface of the pressure side wall. Trip strips are located on the inner surfaces of the cavities to promote turbulence in the cooling air flow to increase the heat transfer from the metal surface to the cooling air.

Pressurized cooling air supplied to the leading edge cooling supply cavity 11 is metered through the leading edge impingement hole 13 and into the leading edge impingement cavity 12 to provide impingement cooling of the leading edge of the blade. The cooling air within the leading edge impingement cavity 12 is then discharged through the showerhead and gill film cooling holes to provide additional cooling to the leading edge region of the blade. pressurized cooling air within the leading edge cooling supply cavity 11 not passed through the leading edge impingement hole 13 is passed through the suction side impingement hole 18 and into the suction side impingement cavity 16 to provide impingement cooling to this cavity, or passed through the pressure side impingement hole 19 and into the pressure side impingement cavity 17 to provide impingement cooling for this cavity. The cooling air in the suction side impingement cavity 16 is discharged out through the row of suction side film cooling holes 20. The cooling air in the pressure side impingement cavity 17 is discharged out through the row of pressure side film cooling holes 21.

The trailing edge or aft region of the blade also has a similar cooling circuit. A trailing edge cooling supply cavity 25 supplies pressurized cooling air from the source to the trailing edge cooling circuit. A pressure side impingement cooling cavity 26 is located on the pressure side of the blade and is connected through one or more metering and impingement holes 28 to the trailing edge cooling supply cavity 25. A row of film cooling holes 30 discharges film cooling air onto the pressure side wall of the blade. A suction side impingement cooling cavity 27 is located on the suction side of the blade and is connected through one or more metering and impingement holes 29 to the trailing edge cooling supply cavity 25. A row of film cooling holes 31 discharges film cooling air onto the suction side wall of the blade. three cooling cavities (33, 34, 35) extending along the trailing edge of the blade and in the blade spanwise direction form a triple impingement cooling circuit with trailing edge metering and impingement holes 39 that connect the trailing edge cooling supply cavity 25 to a row of trailing edge cooling slots 36 that extend along the trailing edge of the blade. A row of film cooling holes on the pressure side of the blade connect each of the three cooling cavities to the external pressure side surface of the blade.

Pressurized cooling air delivered to the trailing edge cooling supply cavity 25 passes through impingement holes into one of three impingement cavities (27, 28, or 33) that are connected through the metering and impingement holes (28, 29, 39) to provide impingement cooling in the respective cavity. Cooling air flows through impingement hole 29 into suction side impingement cavity 27 and then out through film cooling holes 31. Cooling air also flows through metering and impingent hole 28 and into the pressure side impingement cavity 26, and then is discharged through film cooling holes 30 onto the pressure side external wall surface. The remaining cooling air flows through first trailing edge metering and impingement hole 39 and into the first trailing edge impingement cavity 33, then through the second trailing edge impingement hole and into the second trailing edge impingement cavity, and then through the third trailing edge impingement hole and into the third trailing edge impingement cavity 35 located downstream. A row of film cooling holes 41 connect the trailing edge cooling supply cavity 25 to the pressure side surface of the blade. A row of film cooling holes 37 also connect each of the three trailing edge impingement cavities (33, 34, 35) to the pressure side wall surface of the blade. A row of trailing edge cooling slots 36 discharge cooling air from the third impingement cavity 35 out the trailing edge of the blade.

Each of the metering and impingement holes in the cooling circuit above can be sized to regulate the amount of cooling air and the pressure of the cooling air that is passed into the cavities in order to customize the cooling of the different regions and surfaces of the blade. Using segmented cavities instead of a single long cavity will allow for further customization of the cooling in the blade spanwise direction.

Cooling air is supplied through the airfoil leading edge and trailing edge feed channels. For the leading edge feed channel, the cooling air is impinged onto the backside of the leading edge inner surface to provide backside convective cooling for the airfoil leading edge. A portion of the leading edge feed channel flow is also impinged onto the airfoil pressure side and suction side cavity, cooling flow rate and pressure are regulated to each impingement cavity for optimization of cavity pressure at various locations of the airfoil. The spent air is then discharged from the pressure side and suction side cavities onto the airfoil external wall to provide airfoil external film cooling. both of the pressure side impingement cavity and the suction side pressure can be formed as multiple compartments in the blade spanwise direction for tailoring the spanwise hot gas side pressure distribution.

The multiple metering impingement cooling process also provides cooling for the airfoils trailing edge section of the blade. In additional, a triple impingement cooling circuit is used for cooling of the trailing edge portion of the airfoil. Spent cooling air is then discharged from the airfoil trailing edge through a row of metering holes or slots that open on the pressure side of the trailing edge. Rough surfaces such as trip strips are also formed on the inside wall surfaces of the impingement cavities for the enhancement of internal cooling performance.

The cooling circuit of the present invention provides for a precise cooling flow distribution to each section of the airfoil for tailoring the airfoil heat load and also minimizes the airfoil rotational effects on the internal heat transfer coefficient. The use of multiple impingement cooling to cool the blade is less sensitive to the cooling cavity size and achieves a very high internal heat transfer coefficient for a given cooling supply pressure and cooling flow level, and therefore maximizes the use of cooling air for the blade.

I claim the following:

1. A turbine blade for use in a gas turbine engine, the blade comprising:

an airfoil portion having a leading edge and a trailing edge, a pressure side and a suction side;

a leading edge cooling supply cavity to supply cooling air to the blade from a source of pressurized cooling air external to the blade;

a trailing edge cooling supply cavity to supply cooling air to the blade from the source of pressurized cooling air external to the blade;

a leading edge impingement cavity located adjacent to the leading edge of the blade;

a leading edge metering and impingement hole connecting the leading edge cooling supply cavity to the leading edge impingement cavity;

a showerhead arrangement of film cooling holes connected to the leading edge impingement cavity;

a first suction side impingement cavity and a first pressure side impingement cavity both located aft from the leading edge cooling supply cavity;

a first metering and impingement hole connecting the first suction side impingement cavity to the leading edge cooling supply cavity;

a second metering and impingement hole connecting the first pressure side impingement cavity to the leading edge cooling supply cavity;

a second suction side impingement cavity and a second pressure side impingement cavity both located forward from the trailing edge cooling supply cavity;

a third metering and impingement hole connecting the second suction side impingement cavity to the trailing edge cooling supply cavity;

a fourth metering and impingement hole connecting the second pressure side impingement cavity to the trailing edge cooling supply cavity;

a first trailing edge impingement cavity located aft of the trailing edge cooling supply cavity;

a fifth metering and impingement hole connecting the trailing edge cooling supply cavity to the first trailing edge impingement cavity; and, a cooling air exit slot opening along the trailing edge of the airfoil and in fluid communication with the first trailing edge impingement cavity.

2. The turbine blade of claim 1, and further comprising:

a row of film cooling holes connected to each of the first and second suction side and pressure side impingement cavities to discharge film cooling air from the cavity and onto the external surface of the blade.

3. The turbine blade of claim 1, and further comprising:

a row of film cooling holes connected to the trailing edge cooling supply cavity and opening onto the pressure side wall of the blade.

4. The turbine blade of claim 1, and further comprising:

a row of film cooling holes connected to the first trailing edge impingement cavity and opening onto the pressure side wall of the blade.

5. The turbine blade of claim 4, and further comprising:

a second trailing edge impingement cavity connected to the first trailing edge impingement cavity through a trailing edge metering and impingement hole; and, a row of film cooling holes connected to the second trailing edge impingement cavity and opening onto the pressure side wall of the blade.

6. The turbine blade of claim 5, and further comprising:

a third trailing edge impingement cavity connected to the second trailing edge impingement cavity through a trailing edge metering and impingement hole; and, the cooling air exit slot connects the third trailing edge impingement cavity to the external surface of the blade.

7. The turbine blade of claim 1, and further comprising:

the first pressure side and suction side impingement cavities have substantially the same chord-wise length, are both located adjacent to the walls of the blade to provide near wall cooling, and are separated from each other by a rib.

8. The turbine blade of claim 7, and further comprising:

the second pressure side and suction side impingement cavities have substantially the same chord-wise length, are both located adjacent to the walls of the blade to provide near wall cooling, and are separated from each other by a rib.

9. The turbine blade of claim 1, and further comprising:

the leading edge cooling supply cavity and the trailing edge cooling supply cavity both extend from the pressure side wall to the suction side wall of the blade to provide near wall cooling of the blade.

10. The turbine blade of claim 1, and further comprising:

a pressure side gill hole and a suction side gill hole both connected to the leading edge impingement cavity to discharge film cooling air onto the blade external surface.

11. The turbine blade of claim 6, and further comprising:

the first, second and third trailing edge impingement cavities each extend between the pressure side wall and the suction side wall to provide near wall cooling for the trailing edge portion of the blade.

* * * * *